United States Patent [19]

Brody

[11] 4,004,175

[45] Jan. 18, 1977

[54] HIGH VOLTAGE PARTICLE ACCELERATOR UTILIZING POLYCRYSTALLINE FERROELECTRIC CERAMIC MATERIAL

[75] Inventor: Philip S. Brody, Brookmont, Md.

[73] Assignee: The United States of America as represented by the Secretary of the Army, Washington, D.C.

[22] Filed: Dec. 9, 1975

[21] Appl. No.: 639,023

Related U.S. Application Data

[63] Continuation-in-part of Ser. No. 533,365, Dec. 16, 1974, which is a continuation-in-part of Ser. No. 411,853, Nov. 1, 1973, Pat. No. 3,855,004.

[52] U.S. Cl. ..... 313/360; 328/233

[51] Int. Cl.[2] ..... H05H 5/00

[58] Field of Search ..... 313/360, 359; 136/89; 252/629 R; 328/233

[56] References Cited

UNITED STATES PATENTS

| | | | |
|---|---|---|---|
| 2,691,738 | 10/1954 | Matthias | 136/89 UX |
| 3,032,706 | 5/1962 | Wieder | 252/62.9 R X |
| 3,218,562 | 11/1965 | Serduke | 313/360 X |
| 3,421,035 | 1/1969 | Brubaker | 313/360 |
| 3,423,684 | 1/1969 | Purser | 313/360 X |
| 3,793,550 | 2/1974 | Thompson | 313/360 |

*Primary Examiner*—Gerard R. Strecker
*Attorney, Agent, or Firm*—Nathan Edelberg; Robert P. Gibson; Saul Elbaum

[57] ABSTRACT

An apparatus is disclosed which utilizes the high voltage generated by the impingement of illumination upon a polarized polycrystalline ferroelectric ceramic material as the source of a high voltage electric field through which charged particles are accelerated. The application of such device to a D.C. particle accelerator with capabilities similar to accelerators of the Van de Graaf type is shown, a uniform DC electric field being provided not through linking resistors as is the case in the Van de Graaf machine, but rather directly through the intrinsic properties of the ferroelectric ceramic material, the uniformity and magnitude of such field being further improved in at least one preferred embodiment through the utilization of parallel spaced-apart electrodes disposed through the ferroelectric ceramic material and terminating in hoops or other electrodes creating equipotential planes through which a beam of charged particles is accelerated. In yet another embodiment of the instant invention, the provision of such electrodes are dispensed with and advantage is taken of a uniform electric field within the ferroelectric ceramic material disposed parallel to the surface and also existing outside such surface. When two substrates of ferroelectric ceramic material are disposed in a parallel spaced-apart relationship with the spacing in relation to the total length being small and thereafter illuminated, a nearly uniform field exists in the space between such parallel substrates and the beam of charged particles is accelerated through such field between the substrates.

6 Claims, 5 Drawing Figures

HIGH VOLTAGE PARTICLE ACCELERATOR UTILIZING POLYCRYSTALLINE FERROELECTRIC CERAMIC MATERIAL

RIGHTS OF THE GOVERNMENT

The invention described herein may be manufactured, used and licensed by or for the United States Government for governmental purposes without the payment to the inventor of any royalties thereon.

RELATED CASES

This application is a continuation-in-part of prior application Ser. No. 533,365 filed Dec. 16, 1974, which application, in turn, was a continuation-in-part of application Ser. No. 411,853 filed Nov. 1, 1973, now U.S. Pat. No. 3,855,004 issued Dec. 17, 1974.

BACKGROUND OF THE INVENTION

This invention generally relates to high voltage particle accelerators and is particularly directed to the utilization therein as the high voltage source of a class of polycrystalline ferroelectric ceramic materials which have been discovered to produce high voltages upon the application of incident light thereto.

As background, and with particular reference being had to the detailed disclosure in U.S. Pat. No. 3,855,004 and to my copending CIP application Ser. No. 533,365, it has been discovered that an arrangement of an initially polarized polycrystalline ferroelectric ceramic material such as is schematically shown in FIG. 1 of the application drawings produces steady high voltages upon the application thereto of an incident source of electromagnetic radiation, such as light. The magnitude of the voltages produced has been found to be directly proportional to the remanent polarization of the ferroelectric ceramic material, such polarization being effected by the application across said ferroelectric ceramic material of an initial voltage pulse, the polarity of the initial voltage pulse and thus the polarity of the remanent polarization within the ferroelectric ceramic material fixing the polarity of the photovoltage developed. The magnitude of the voltage developed is proportional to the length $l$ of the sheet of material provided. The magnitude is also proportional to the number of grains per unit length within the material.

When illuminated at intensity levels such as that produced by direct sunlight or such as that produced by a fluorescent lamp, or such as produced by intense monochromatic or polychromatic laser radiation, for example, these ferroelectric ceramic materials will behave as voltage sources in series with a high output resistance and with the output resistance of the device varying in accordance with the wave length of the incident illumination and decreasing as the intensity of illumination increases. The open circuit photovoltages produced by such devices is extremely high. For example, and with specific reference to the composition $Pb(Zr_{.65}Ti_{.35})O_3$ with 7% of the lead substituted by lanthanum, when composed of 2–4 micron grains produces, when illuminated as shown in FIG. 1, 1500 volts for every centimeter of length between the electrodes. A single $1_{cm}$ square unit thus directly produces 1500 volts.

The extremely high voltages capable of production by such ferroelectric ceramic materials find direct utilization in devices which are alternatives to apparatus presently utilized for the generation of extremely high DC voltages at low currents, such as the Van de Graaf belt machine in which high voltages are produced by mechanically moving electric charges, and in which such high voltages are utilized to accelerate a beam of charged particles.

SUMMARY OF THE INVENTION

The instant invention has as its primary objective the provision of a device which constitutes an improved particle accelerator and which utilizes electrically polarized polycrystalline ferroelectric ceramic materials as the high voltage source.

In its basic embodiment, this primary objective is realized by the instant invention which, in an apparatus for accelerating charged particles including means for generating a high voltage electric field, a source of charged particles which are accelerated through the field, and a target towards which the accelerated particles are directed, constitutes the novel improvement wherein the means for generating the high voltage electric field comprises a substrate of a polycrystalline ferroelectric ceramic material, the substrate having been electrically polarized by the application thereacross of a voltage pulse such that the substrate displays a remanent polarization, and a source of electromagnetic radiation impinging upon the material of the substrate such that the substrate produces the high voltage electric field through which the charged particles are accelerated.

In one embodiment of the instant invention, a single substrate is provided divided into a plurality of stacked layers by a plurality of parallel spaced-apart electrodes disposed through the substrate, the spaced-apart electrodes providing equipotential planes and terminating, for example, in a hoop through which the charged particles are accelerated.

In yet another embodiment of the instant invention, the uniform high voltage electric field is produced by the provision of two substrates of the polarized polycrystalline ferroelectric ceramic material, these substrates being provided in a parallel spaced-apart relationship with respect to one another and with the direction of remanant polarization within each substrate being aligned. The source of electromagnetic radiation impinges upon the material of each substrate such that an electric field is produced in the space between the substrates, the charged particles being accelerated through such space.

In a still further embodiment of the instant invention designed to constitute a replacement for the Van de Graaf-type machine, a plurality of substrates of ferroelectric ceramic material are provided in a vertically stacked relationship with each substrate being in the form of a circular wedge aligned in a coaxial manner with one another with ring electrodes being disposed between each circular wedge, each ring electrode defining an equipotential plane. An elongated evacuated acceleration tube is disposed between the source of charged particles and the target therefor, the tube being further disposed through the ring electrodes. In a fashion similar to that of the Van de Graaf generator, a conductive hemisphere may be provided at one end of the acceleration tube electrically connected to the top-most circular wedge, and a conductive ground plane may be provided at the other end of the tube electrically connected to the lowermost circular wedge, and a housing surrounding the apparatus may further be provided, such housing preferably being filled with an electrically insulating medium. The source of electromagnetic radiation necessary so as to generate the high voltage from the ferroelectric ceramic materials can constitute a plurality of illumination devices, such as fluorescent lights, disposed within the housing.

BRIEF DESCRIPTION OF THE DRAWINGS

The invention itself will be better understood, and further features and advantages thereof will become apparent from the following detailed description of the preferred inventive embodiments, such description making reference to the appended drawings wherein.

DETAILED DESCRIPTION OF THE PREFERRED INVENTIVE EMBODIMENT

Figure 1:
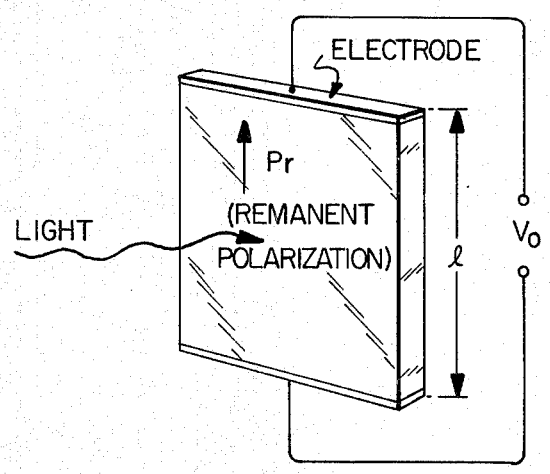
FIG. 1 is a schematic diagram illustrating the manner in which high voltage is generated by illumination impinging upon the surface of a substrate of an electrically polarized ferroelectric ceramic material.
Figure 2:
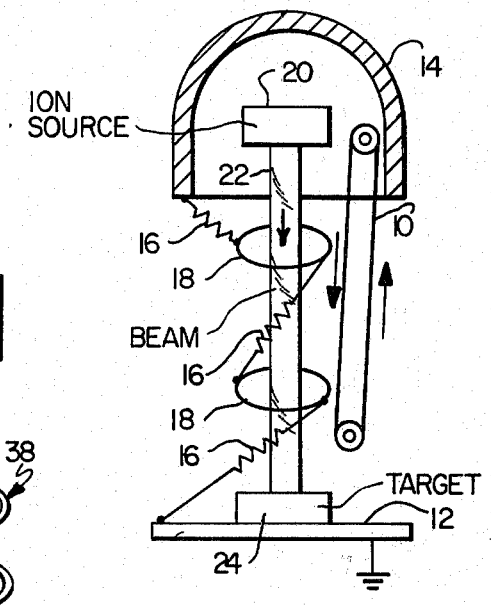
PRIOR ART FIG. 2
FIG. 2 is a schematic illustration of a prior-art Van de Graaf-type DC particle accelerator.

With reference now being had to FIG. 2 of the application drawings, a schematic illustration of a conventional electrostatic accelerator of the Van de Graaf type is shown. Although not illustrated, the entire apparatus typically is enclosed within an insulating gas atmosphere so as to prevent voltage breakdown.

In the Van de Graaf type machine, a rapidly moving belt 10 continuously conveys either positive or negative charges from ground 12 to an isolated conductive hemisphere 14 bringing such hemisphere to a desired high positive or negative potential. A uniform voltage gradient is established between the hemisphere 14 and the ground plane 12 by returning current through a plurality of series resistors 16 connected consecutively to hoop electrodes 18 so as to produce equipotential planes.

Electrons, ions, or other charged particles are produced at a source 20 at the high potential end of the machine and are guided, preferably through an evacuated insulating tube 22 within the apparatus, into the uniform electric field produced by the equipotential plane and accelerated towards a target 24 at the ground plane 12, the particles reaching the ground plane with high energy in a collimated beam.

In DC operation, this beam current is limited to the rate at which charge is conveyed to the high voltage hemisphere 14 which depends on the width and the speed of the belt. Further, the potentials generated are additionally practically limited by the electrical characteristics of the series resistors 16 and particularly their break-down potential and the like. In practice, and with very high voltage machines of this general type, the physical size of such series resistors becomes unwieldy.

The instant invention provides an alternative to the Van de Graaf type high voltage particle accelerator, an alternative which does not suffer from the above-noted disadvantages.

Figure 3:
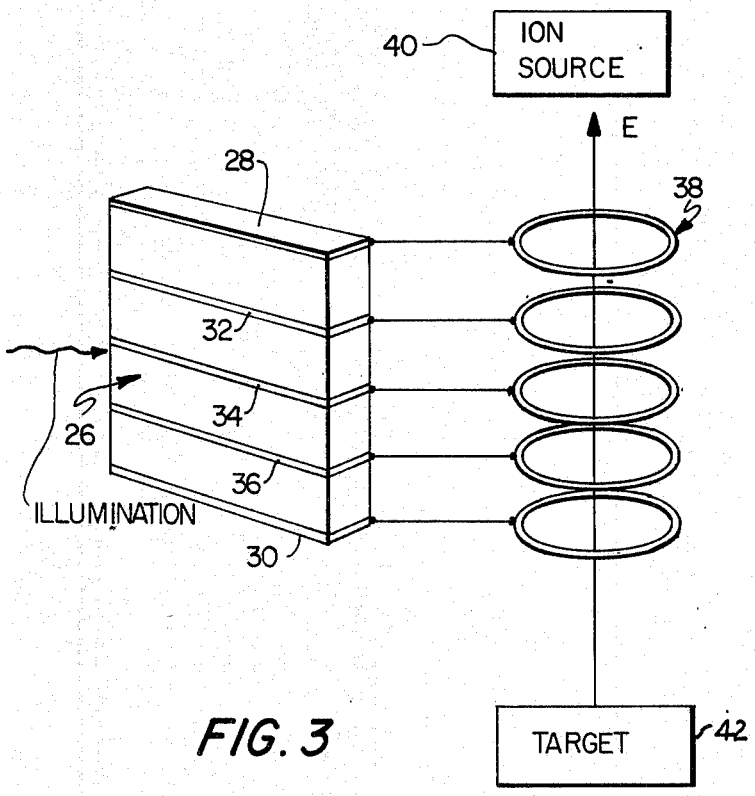
FIG. 3 is a perspective illustration of the utilization of a substrate of ferroelectric ceramic material divided into stacked-layers by a plurality of spaced-apart electrodes terminating in hoops as the mechanism by which a uniform high voltage electric field is produced.

With specific reference now being directed to FIG. 3 of the application drawings, the manner in which this alternative is applied as the high voltage energy source is shown.

Specifically, a substrate of a polycrystalline ferroelectric ceramic material, such as the composition of $Pb(Zr_{.65}Ti_{.35})O_3$ with 7% of the lead substituted by lanthanum, as indicated by reference numeral 26 is provided, such substrate having been initially electrically polarized by the application thereacross of a voltage pulse such that the material displays a remanent polarization. Upon the application thereto of electromagnetic energy such as light impinging thereon, the substrate will display a high potential across the two outer electrodes 28 and 30, the magnitude of such voltage being proportionate to the length of the substrate as was discussed at the outset. Larger and more uniform fields can be produced by providing a plurality of parallel spaced-apart electrodes disposed through these substrates such as is shown at 32,34 and 36 so as to define a plurality of stacked layers, with the spaced-apart electrodes terminating in hoops generally designated by reference numeral 38, for example, each hoop defining an equipotential plane. The charged particles would thereafter be accelerated through the electric field by being directed through the center of the hoops from an ion source 40 to a target 42.

Figure 4:
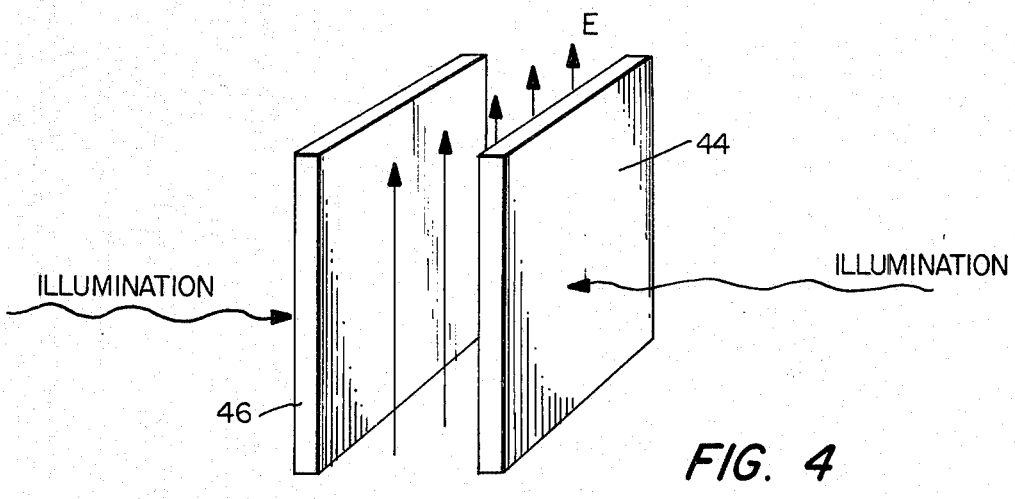
FIG. 4 is a perspective illustration of the generation of a uniform high voltage electric field through which charged particles may be accelerated in the location between two spaced apart substrates of polarized polycrystalline ferroelectric ceramic material, an illumination source being provided for each said substrate.

A further embodiment of the instant invention in this particular environment is that depicted in FIG. 4 of the application drawings. Here, two substrates of polarized polycrystalline ferroelectric material 44 and 46 are provided in a parallel spaced-apart relationship with respect to one another. The direction of the remanent polarization within each substrate is, of course, aligned and a plurality of illumination sources are provided such that electromagnetic radiation impinges upon the material of each substrate. Since the voltage produced by the ferroelectric ceramic material is proportional to the length between the upper and lower edges (or electrodes) of the substrate, a uniform field E exists within the material parallel to the surface. In that the tangential component of this field E is continuous, the field therefore also exists outside the surface. As such, a nearly uniform electric field would exist between the illuminated parallel sheets as is depicted in FIG. 4 and electrons or ions or other charged particles introduced into this field will be accelerated along the direction of the field.

Figure 5:
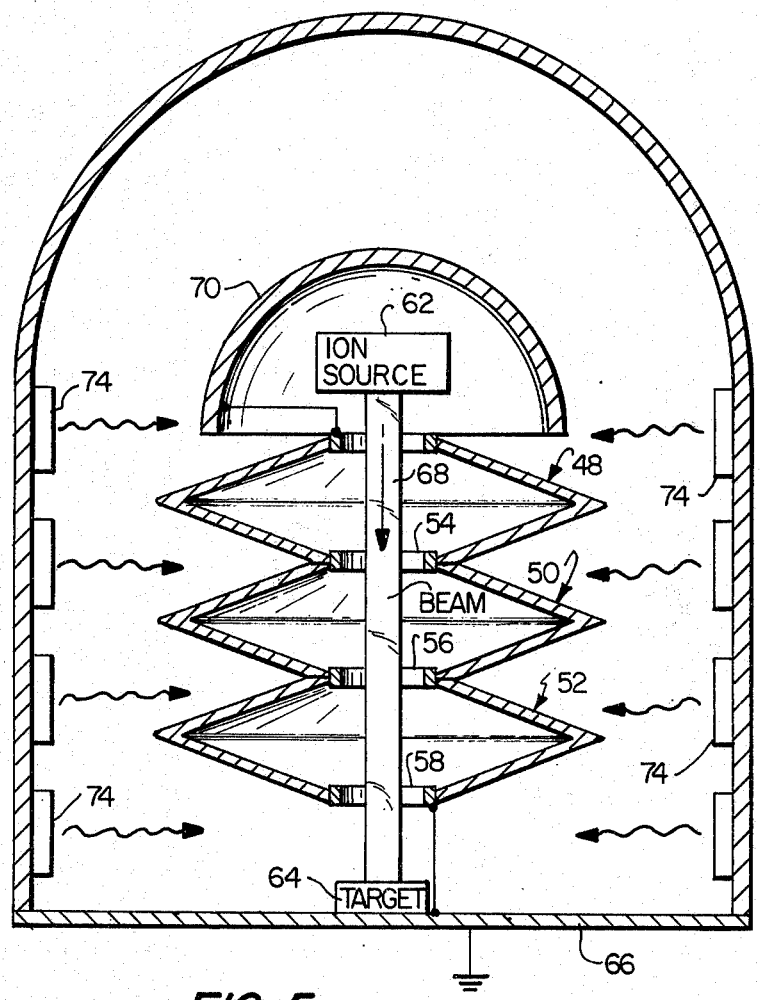
FIG. 5 is a schematic elevational view, partially in section for illustrative clarity, of a particular embodiment of the instant inventive high voltage DC particle accelerator.

The direct application of the ferroelectric ceramic materials as the high-voltage source in a DC particle accelerator of the Van de Graaf type can be seen in the specific preferred embodiment illustrated in FIG. 5 of the application drawings. Here, a plurality of substrates of polarized polycrystalline ferroelectric ceramic material 48,50 and 52, for example, are provided in the form of a circular wedge aligned in a coaxial manner with one another in a vertically stacked relationship. Ring electrodes 54,56 and 58, for example, are disposed between each circular wedge 48,50 and 52 so as to electrically connect each wedge in a series relationship such that the voltages produced by each wedge are additive and further serve to define equipotential planes. A source of charged particles 62 is put at one end, such as the high potential end, of the apparatus, and a target 64 is provided at the other end of the apparatus at the ground plane 66. An evacuated acceleration tube 68 is disposed between the source and the target through the center of the ring electrodes 54,56 and 58.

So as to accommodate the operation in a pulsed acceleration mode as well as a DC mode, a conductive hemisphere 70 is provided at one end of the acceleration tube and is electrically connected to the top-most circular wedge 48. The lower-most circular wedge 52 is connected to the ground plane 66. Further, and in a fashion typical to the Van de Graaf particle accelerator, a housing 72 would be provided in a surrounding relationship with respect to the apparatus, the housing being filled with an electrically insulating medium such as a $SF_6$ atmosphere. With this embodiment, the source of electromagnetic radiation necessary to impinge upon the surface of each ferroelectric ceramic wedge is contemplated to constitute a plurality of illumination devices such as fluorescent lights 74 and further, in the preferred inventive embodiment, the inner surface of the surrounding housing 72 is contemplated to be polished so as to define a reflecting surface for the electromagnetic radiation thus maximizing the impingement of such illumination upon the ferroelectric ceramic material.

The direction of the electric field produced by the plurality of circular wedges and thus the sign of the charged particle that can be accelerated can readily be controlled by either reversing the direction of the remanent polarization of each ferroelectric ceramic wedge, or by removing and physically reversing each wedge 48,50 and 52, each wedge being contemplated to constitute a modular unit.

It will be appreciated that the particular characteristics of the voltage field generated by the apparatus of FIG. 5 will depend on the number of circular wedges provided, on the specific ferroelectric ceramic material utilized, and on the intensity and spectral characteristics of the incident illumination. One typical example of specific dimensions and characteristics of such a device is as follows:

Material $Pb(Zr_{.47}Ti_{.53})O_3$ + 1 wt% niobium oxide sheet material 0.007 inch thick or thicker
Input illumination wattage at 382 $\eta$m; 1 watt/cm$^2$
Outside dia. of circular wedge 6 m
Inside dia. of circular wedge 1 m
Wedge thickness 0.25 m
Wedge separation 0.10 m
Total number wedge 50
Total height 17.5 m
Max open circuit voltage $15 \times 10^6$V
Short circuit photoresistance constant $2 \times 10^{10}$ $\Omega$/sq/watt/cm$^2$
Max (short circuit) current 0.05 milliamperes
Max voltage at max beam power $7.5 \times 10^6$ volts
Max current at max beam power $0.25 \times 10^{-4}$ amperes
Total 382 m illumination wattage required for max beam power $2.75 \times 10^6$ watts
Total 382 nm illumination wattage required for $1 \times 10^6$ amperes and $7.5 \times 10^6$ volts $110 \times 10^3$ watts
Approx. total lamp wattage required using $\beta$L type fluorescent lamps for $1 \times 10^{-6}$A current at $7.5 \times 10^6$ volts $5000 \times 10^3$ watts While there has been shown and described several preferred embodiments of the instant invention, those skilled in the art should appreciate that such embodiments are exemplary and not limiting and are to be construed within the scope of the following claims.

What is claimed is:

1. In an apparatus for accelerating charged particles including means for generating a high voltage electric field, a source of charged particles which are accelerated through said field, and a target towards which said accelerated particles are directed, the improvement wherein said means for generating a high voltage electric field comprises a substrate of a polycrystalline ferroelectric ceramic material, said substrate having been electrically polarized by the application thereacross of a voltage pulse such that said substrate displays a remanent polarization; and a source of electromagnetic radiation impinging upon the material of said substrate, whereby said substrate produces said high voltage electric field.

2. The apparatus of claim 1, wherein two substrates of said polarized polycrystalline ferroelectric material are provided in a parallel spaced apart relationship with respect to one another and with the direction of remanent polarization being aligned, said source of electromagnetic radiation impinging upon the material of each substrate, and wherein said charged particles are accelerated through an electric field between said two spaced apart substrates

3. An apparatus as defined in claim 1, wherein a plurality of parallel spaced apart electrodes are disposed through said substrate so as to define a plurality of stacked layers, said spaced apart electrodes providing equipotential planes for accelerating said charged particles.

4. An apparatus as defined in claim 3. wherein said electrodes terminate in hoops through which said charged particles pass.

5. An apparatus as defined in claim 1, wherein a plurality of substrates are provided in a vertically stacked relationship, each substrate being in the form of a circular wedge aligned in a coaxial manner with one another, with ring electrodes being disposed between each circular wedge, each said ring electrode defining an equipotential plane, and an elongated evacuated acceleration tube disposed between said source of charged particles and said target and through said ring electrodes.

6. An apparatus as defined in claim 5, further including a conductive hemisphere at one end of said acceleration tube electrically connected to the top-most circular wedge, and a conductive ground plane at the other end of said tube electrically connected to the lower-most circular wedge, and a housing surrounding said apparatus and filled with an electrically insulating medium, and wherein said source of electromagnetic radiation comprises a plurality of illumination devices disposed within said housing.

* * * * *